United States Patent [19]

Vernikov et al.

[11] Patent Number: 4,829,397

[45] Date of Patent: May 9, 1989

[54] APPARATUS FOR DEMAGNETIZING PARTS

[75] Inventors: Arkady Y. Vernikov; Mikhail P. Rashkovich; Matus E. Barab-Tarle; Iosif I. Gamarnik; Boris A. Trostanovsky; Alexandr S. Khinkus, all of Odessa, U.S.S.R.

[73] Assignee: Odesskoe Spetsialnoe Konstruktorskoe Bjuro Spetsialnykh Stankov, Odessa, U.S.S.R.

[21] Appl. No.: 168,547

[22] Filed: Mar. 9, 1988

Related U.S. Application Data

[63] Continuation of Ser. No. 939,481, filed as PCT SU85/00017 on Feb. 28, 1985, published as WO86/05313 on Sep. 12, 1986, abandoned.

[51] Int. Cl.[4] ..... H01F 13/00

[52] U.S. Cl. ..... 361/149; 361/267

[58] Field of Search ..... 361/143, 149, 267

[56] References Cited

U.S. PATENT DOCUMENTS 3,110,282 11/1963 Foerster ..... 361/149
3,506,884 4/1970 McKinley ..... 361/151
3,583,052 6/1971 Herbenar et al. ..... 403/43

FOREIGN PATENT DOCUMENTS 457108 1/1975 U.S.S.R. .

OTHER PUBLICATIONS

Bower, W. F., "Demagnetizing Parts of Anti-Friction Bearings" In: Elec. World (Feb. 2, 1946), pp. 86–87.

*Primary Examiner*—Michael L. Gellner
*Assistant Examiner*—David Gray
*Attorney, Agent, or Firm*—Fleit, Jacobson, Cohn & Price

[57] ABSTRACT

An apparatus for demagnetizing parts after they have been subjected to the action of a magnetic field having coils (1,2) connected to an a-c power supply source and disposed one inside the other at one and the same angle with respect to a trough (3) extending through the inner coil. The coils (1,2) are mounted in such a manner that the angle ($\alpha$) therebetween can be adjusted.

7 Claims, 3 Drawing Sheets

APPARATUS FOR DEMAGNETIZING PARTS

This application is a continuation at Ser. No. 939,481, filed as PCT SU85/00017 on Feb. 28, 1985, published as WO86/05313 on Sep. 12, 1986, now abandoned.

FIELD OF THE ART

The invention relates to the machine tool engineering, and more specifically, it deals with apparatuses for demagnetizing parts (demagnetizers) after they have been subjected to the action of a magnetic field.

STATE OF THE ART

Known in the art is an apparatus for demagnetizing parts, comprising a trough for conveyance of parts being demagnetized, the trough extending through a pair of coils which are installed along the trough at an angle $\alpha=90°$ to each other. The coils are connected to a-c power supply sources having a relative phase shift of $\phi=90°$ (cf. U.S. Pat. No. 3506884). As the sum $(\alpha+\phi)$ of the space $(\alpha)$ and time $(\phi)$ angles is 180°, the coils generate a circular demagnetizing field rotating in space. The apparatus is designed for demagnetizing parts which are predominantly round and, as the coils are spaced along the trough, the parts are not always uniformly demagnetized in all directions.

Also known in the art is an apparatus for demagnetizing parts, comprising a trough for the passage of parts and a pair of coils which are mounted one inside the other at one and the same angle with respect to the trough extending through the inner coil. The angle $\alpha$ between the coils is 60(120)°. The coils are connected to a three-phase power supply source in such a manner that a phase shift $\phi$ of their supply voltage is 120(60)°, i.e. $\alpha+\phi=180°$ (cf. USSR Inventor's Certificate No. 457108).

However, because of frequent distortions of voltage in the mains, the phase shift between supply voltages of the coils will be other than 120(60)°. In addition, even if the phase shift between these voltages is equal to that specified, the phase shift between currents of the coils creating the magnetic flux will inevitably be other than 120(60)°.

This is due to the fact that phase shifts of current in each coil with respect to its supply voltage are not identical because of different cos $\phi$ of the coils, differences in their dimensions and shape and also because of the influence of mutual induction of the coils on cos $\phi$.

Therefore, the phase shift between currents of the coils differs from 120(60)° and is $120°\pm\Delta\phi(60\pm\Delta\phi)$.

This results in the magnetic field created by the apparatus having an elliptical configuration, rather than circular one, and its demagnetizing effect along the small diameter of the ellipse is inadequate.

For a good demagnetization of bodies of revolution, coil currents should be raised thus bringing about an increase in the coils heating and higher power requirements.

Prior art apparatus are not very good in demagnetizing elongated bodies such as shafts, bars, strips, and the like.

DISCLOSURE OF THE INVENTION

The invention is based on the problem of providing an apparatus for demagnetizing parts in which the coils are mounted in such a manner as to allow the configuration of a demagnetizing field to be varied in accordance with the configuration of parts.

This problem is solved by that in an apparatus for demagnetizing parts after they have been subjected to the action of a magnetic field, comprising coils connected to an a-c power supply source and mounted one inside the other at one and the same angle with respect to a trough extending through the interior of the inner coil, according to the invention, the coils are mounted in such a manner that the angle therebetween can be varied.

It is preferred that the coils have leads for connecting to line and phase voltages of a three-phase mains.

This connection makes it possible to change the phase shift between supply currents of the coils thereby varying the configuration of the demagnetizing field within a larger range as compared to that obtainable by merely adjusting the angle between the coils.

The apparatus is preferably provided with a pick-up for sensing the residual magnetization of a part mounted upstream the point at which the trough enters the coils, and a coil supply voltage regulator connected to the pick-up.

This facility makes it possible to vary amplitude of the demagnetizing field depending on the degree of magnetization of a given part, which is to be demagnetized.

The apparatus according to the invention for demagnetizing parts is very simple in structure and makes it possible to demagnetize parts of practically any configuration uniformly in all directions with a comparatively low energy consumption.

BRIEF DESCRIPTION OF THE DRAWINGS

The invention will now be described with reference to specific embodiments thereof illustrated in the accompanying drawings, in which.

PREFERRED EMBODIMENT OF THE INVENTION

Figure 1:
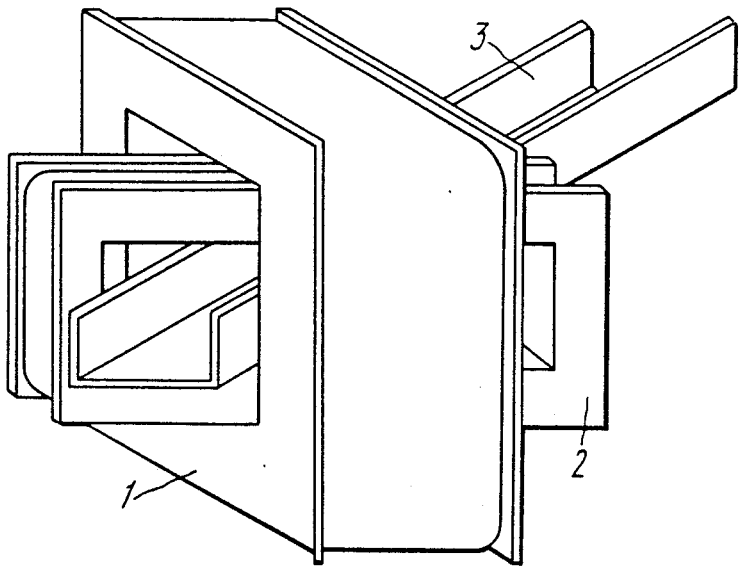
FIG. 1 shows a general view of an apparatus for demagnetizing parts without a mechanism for adjusting the angle between coils.

An apparatus comprises coils 1 and 2 (FIG. 1) which are mounted one inside the other, and a trough 3 extending through the interior of the inner coil 2.

Figure 2:
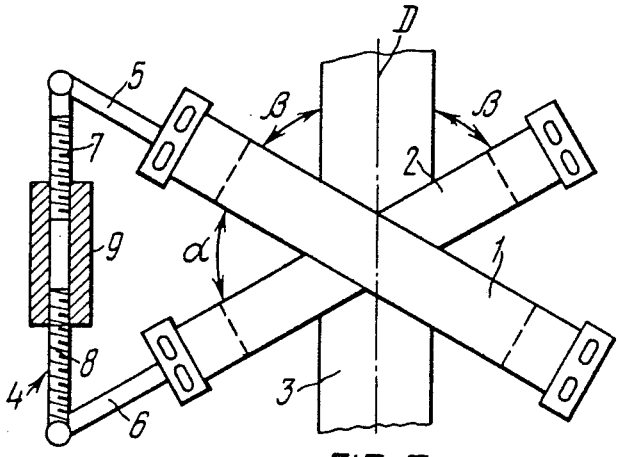
FIG. 2 is ditto, a plan view with a mechanism for adjusting the angle between coils.

The coils 1 and 2 extend at one and the same angle $\beta$ (FIG. 2) with respect to the trough 3 and at an angle $\alpha$ with respect to each other. The coils 1 and 2 are mounted in such a manner that the angle $\alpha$ therebetween can be adjusted, and for that purpose there is provided a mechanism 4 for rotating the coils 1 and 2. The mechanism 4 comprises two pull rods 5 and 6, each having one end thereof connected to the coil 1 and 2, respectively. The other ends of the pull rods 5 and 6 are pivotally connected to pull rods 7 and 8, respectively. The pull rods 7 and 8 have their opposite ends provided with a thread. These ends of the pull rods 7 and 8 are threaded into a nut 9.

Figure 3:
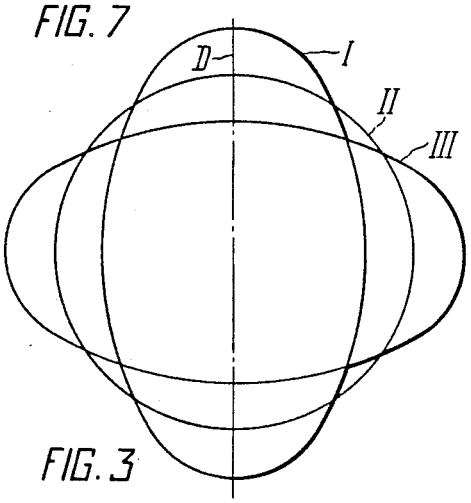
FIG. 3 shows hodographs of intensity of a magnetic field created by an apparatus for demagnetizing parts according to the invention.

A change in the angle $\alpha$ between the coils allows the configuration of a demagnetizing field I, II, III to be varied as shown in FIG. 3. Such variation is limited by the dimensions of the coils 1 and 2.

Leads 10, 11 and 10*a* and 11*a* of the coils 1 and 2 (FIGS. 4–8) are connected to line voltages of a three-phase mains, and the leads 10 and 10*a* correspond to the starts and the leads 11 and 11*a* correspond to the ends of the coil windings.

In order to change the configuration of a demagnetizing field I, II and III (FIG. 3) within larger ranges, the coils 1 and 2 have additional leads 12 and 12*a* for connecting to phase voltages of a three-phase mains.

Figure 4:
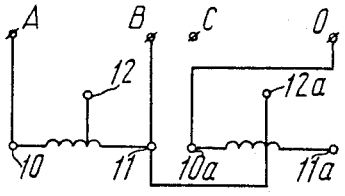
FIGS. 4–8 show embodiments of different connections of coils to a three-phase mains.

When the first 1 and second 2 coils (FIG. 2) are connected into a configuration shown in FIG. 4, where A, B, C, O are leads of a three-phase supply mains, the phase "A" is connected to the lead 10 of the first coil, the phase "B" is connected to the lead 11 of the first coil and to the lead 12*a* of the second coil, and the zero lead is connected to the lead 10*a* of the second coil.

Figure 9:
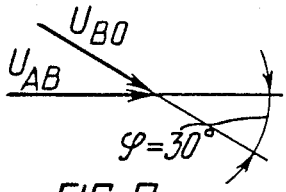
FIGS. 9–13 are vector diagrams of coil voltages corresponding to the embodiments of their connections shown in FIGS. 4–8.

With this circuit configuration, the phase shift $\phi$ between supply voltages of the coils 1 and 2 is 30° as shown in FIG. 9 between vectors of line voltage $U_{BA}$ and phase voltage $U_{BO}$.

Figure 5:
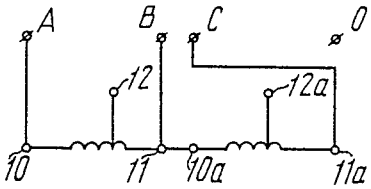
Figure 10:
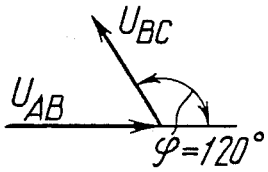

When the coils are connected in a configuration shown in FIG. 5, the lead 10*a* of the second coil is connected to the lead 11 of the first coil, and the lead 11*a* of the second coil is connected to the phase "C" of the mains. With this circuit configuration, the angle $\phi$ between line voltages $U_{AB}$ and $U_{BC}$ of coil supply is 120° as shown in FIG. 10.

Figure 6:
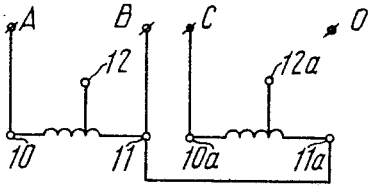
Figure 11:
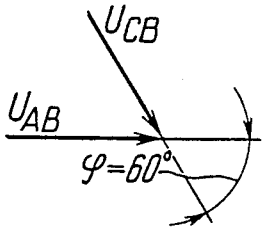

When the coils are connected in a configuration shown in FIG. 6, the lead 11*a* of the second coil is connected to the lead 11 of the first coil, and the lead 10*a* of the second coil is connected to the phase "C" of the mains. This circuit configuration ensures the phase shift $\phi=60°$ between line voltage $U_{AB}$ and $U_{CB}$ if coil supply as shown in FIG. 11.

Figure 7:
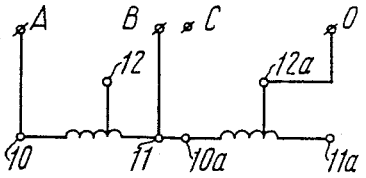
Figure 12:
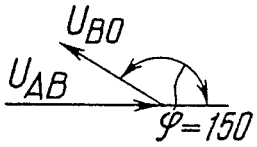

When the coils are connected in a configuration shown in FIG. 7, the lead 10*a* of the second coil is connected to the lead 11 of the first coil, and the lead 12*a* of the second coil is connected to the zero (0) lead of the mains. This circuit configuration ensures the phase shift $\phi=150°$ between line voltage $U_{AB}$ and phase voltage $U_{BO}$ of coils supply as shown in FIG. 12.

Figure 8:
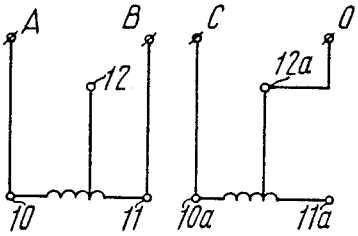
Figure 13:
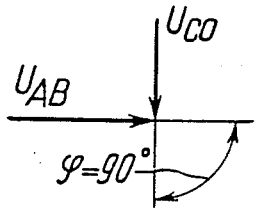

When the coils are connected in a configuration shown in FIG. 8, the lead 10*a* of the second coil is connected to the "C" phase of the mains, and the lead 12*a* of the second coil is connected to the zero (0) lead of the mains. This circuit configuration ensures the phase shift $\phi=90°$ between line voltage $U_{AB}$ and phase voltage $U_{CO}$ of coils supply as shown in FIG. 13.

Figure 14:
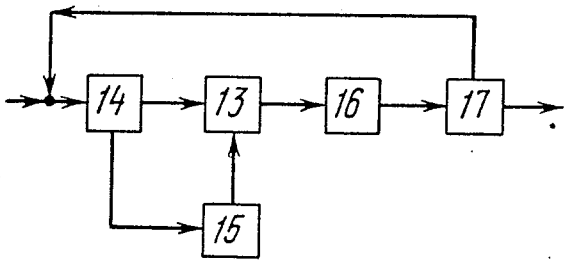
FIG. 14 is a block diagram illustrating coil supply voltage control according to the invention.

In order to vary the supply voltage of the coils in an apparatus 13 for demagnetizing depending on the amount of residual magnetization of a part to be demagnetized, a pick-up 14 sensing residual magnetization of a part is provided on the trough 3 (FIG. 14) upsteam the entrance to the apparatus 13. The pick-up 14 is electrically coupled to a regulator 15 for controlling supply voltage of the coils in the apparatus 13.

The demagnetizing apparatus functions: in the following manner.

Before energizing the apparatus, it is adjusted in such a manner that the configuration of the demagnetizing field should correspond to the shape of a part to be demagnetized. Thus, if a part such as a shaft moves along the trough 3 in such a manner that the shaft axis runs in parallel, or is aligned with the axis "D" of the trough, the demagnetizing field should be of the elliptical configuration I as shown in FIG. 3. This configuration of the field is obtained by diminishing the angle $\alpha$ between the coils 1 and 2 by turning the nut 9 or by connecting the coils 1 and 2 to the three-phase mains in one of the configuration shown in FIGS. 4–8 so that $\alpha+\phi<180°$.

The sum of these angles should differ from 180° the stronger the larger is the extent of the part being demagnetized.

If a part such as a shaft moves along the trough 3 in such a manner that the shaft axis extends at right angles to the axis D of the trough 3, the demagnetizing field III should be eilliptical as shown in FIG. 3. For that purpose the angle $\alpha$ between the coils 1 and 2 is increased by turning the nut 9, or the coils 1 and 2 are connected to the three-phase mains so that $\alpha+\phi>180°$.

In demagnetizing parts such as rings or round discs, the apparatus is adjusted as described above in such a manner that $\alpha+\phi=180°$. The demagnetizing field II will be circular in shape as shown in FIG. 3.

Therefore, the apparatus allows the configuration of the demagnetizing field to be changed depending on the shape of parts being demagnetized.

When a part to be demagnetized arrives at the trough 3 of the apparatus 13, the pick-up 14 sensing residual magnetization of a part measures maximum value of residual magnetization on the part surface and sends a corresponding signal back to a unit 15 for varying supply voltage of the coils 1,2 of the apparatus 13. The unit 15 changes the supply voltage of the apparatus 13 in such a manner as to ensure a pre-set degree of demagnetization of the incoming parts with minimum electric energy consumption.

Therefore, the apparatus makes it possible to vary supply voltage of the demagnetizing coils 1 and 2 depending on the amount of residual magnetization of parts being demagnetized.

After the part leaves the apparatus 13, a pick-up 16 measures residual magnetization of the part after its demagnetization. If the magnetization overpasses a pre-set level, the pick-up 16 sends a signal back to an interceptor 17 which will feed the part back to the entrance to the apparatus 13. If the magnetization of a part complies with the pre-set level, the interceptor 17 will allow it to pass to a discharge.

A pilot sample of an apparatus for demagnetizing parts made in accordance with the invention was tested in demagnetizing parts of varius shapes and dimensions and showed good results. Thus, in demagnetizing bearings rings with the outside diameter of 200 mm a residual magnetization did not exceed 1.5 Oe.

INDUSTRIAL APPLICABILITY

The invention may be most advantageously used in machine tools having magnetic workpiece holders employed during machining.

The invention may also be used for demagnetizing parts after their conveyance by means of a magnetic conveyor, magnetic gripper or other similar means.

The apparatus may also be used for demagnetizing parts after the magnetic flaw detection.

We claim:

1. In an apparatus for demagnetizing parts after they have been subjected to the action of a magnetic field, including a pair of coils connected to an a-c power supply source and angularly adjustably mounted one inside the other at one and the same angle with respect to a trough extending through the inner coil, the improvement comprising adjustable means connected between the coils for adjusting the angle between the coils while, in all positions of adjustment, retaining the respective coils both at the same angle to the trough.

2. An apparatus according to claim 1, wherein the coils have leads for connecting to line and phase voltages of a three-phase mains.

3. An apparatus according to claim 1, further including a pick-up for sensing residual magnetization of a part disposed outside the point at which the trough enters the coils, and a regulator controlling the electrical supply to the coils coupled to the pick-up.

4. An apparatus according to claim 1 wherein the means for adjusting the angle between the coils comprises first pull rods extending from adjacent ends of the respective coils, second threaded pull rods pivotally connected to the respective first pull rods, and an adjustment nut connected between the second pull rods.

5. Apparatus for demagnetizing parts after they have been subjected to the action of a magnetic field including a pair of coils connected to an a-c power source for generating a demagnetizing field, the coils being angularly adjustably mounted one inside the other at the same angle with respect to a trough extending through the inner coil, the coils having an angle therebetween and the apparatus including means for changing the configuration of the demagnetizing field, said means comprising adjustment means for varying the angle between the coils.

6. Apparatus as claimed in claim 5 wherein the power source is a three-phase power source and the coils are provided with additional leads for connected to phase voltages.

7. Apparatus as claimed in claim 5 wherein the adjustment means is connected between the coils for retaining the respective coils both at the same angle to the trough in all positions of adjustment.

* * * * *